US006536725B2

(12) United States Patent
Fisher

(10) Patent No.: US 6,536,725 B2
(45) Date of Patent: Mar. 25, 2003

(54) TABLE LEG LEVELING DEVICE

(76) Inventor: Todd Fisher, 3507 Ladrillo Aisle, Irvine, CA (US) 92606

( * ) Notice: Subject to any disclaimer, the term of this patent is extended or adjusted under 35 U.S.C. 154(b) by 0 days.

(21) Appl. No.: 09/844,611

(22) Filed: Apr. 27, 2001

(65) Prior Publication Data

US 2002/0158173 A1 Oct. 31, 2002

(51) Int. Cl.[7] ..... F16M 11/24
(52) U.S. Cl. ..... 248/188.4
(58) Field of Search ..... 248/188.4, 188.2, 248/188.1, 188, 205.3, 683

(56) References Cited

U.S. PATENT DOCUMENTS 2,578,826 A * 12/1951 Mrofka ..... 38/117
3,326,508 A * 6/1967 Born ..... 248/346.1
4,312,088 A * 1/1982 Webb ..... 5/509
5,060,896 A * 10/1991 Hobbins ..... 248/188.2
5,116,004 A * 5/1992 Luecke ..... 248/161
5,148,892 A * 9/1992 Lu ..... 182/201
5,169,259 A * 12/1992 Cornell, Jr. et al. ..... 403/309
5,345,631 A * 9/1994 Saperstein et al. ..... 5/509.1
5,501,754 A * 3/1996 Hiraguri ..... 156/71
5,680,673 A * 10/1997 Beshore ..... 16/42 R
5,802,669 A * 9/1998 Wurdack ..... 16/42 R
6,327,985 B1 * 12/2001 Frenkler et al. ..... 108/147.19

* cited by examiner

*Primary Examiner*—Ramon O. Ramirez
*Assistant Examiner*—Kofi Schulterbrandt
(74) *Attorney, Agent, or Firm*—Goldstein & Lavas, P.C.

(57) ABSTRACT

A table leg leveling device including a base member having an upper end and a lower end. The upper end is adapted for coupling with a free lower end of a table leg. The lower end of the base member has an internally threaded aperture extending upwardly therein. An extension member is adapted for being adjustably received within the internally threaded aperture of the lower end of the base member. The extension member includes a threaded rod having an upper end and a lower end. The upper end is adjustably positioned within the internally threaded aperture.

6 Claims, 1 Drawing Sheet

TABLE LEG LEVELING DEVICE

BACKGROUND OF THE INVENTION

The present invention relates to a table leg leveling device and more particularly pertains to stabilizing furniture on uneven ground or the like for improved use.

The use of leveling devices is known in the prior art. More specifically, leveling devices heretofore devised and utilized for the purpose of balancing items are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,830,320 to Bellows discloses means for stabilizing an article of furniture; however, it appears to be wedge-shaped. U.S. Pat. No. 4,101,106 to Denkinger discloses a leveling device for a table or chair; however, it appears to be screwed into the leg. U.S. Pat. No. 4,015,808 to Carroll discloses a combination leveling and shock absorbing device for a cabinet.

While these devices fulfill their respective, particular objective and requirements, the aforementioned patents do not describe a table leg leveling device for stabilizing furniture on uneven ground or the like for improved use.

In this respect, the table leg leveling device according to the present invention substantially departs from the conventional concepts and designs of the prior art, and in doing so provides an apparatus primarily developed for the purpose of stabilizing furniture on uneven ground or the like for improved use.

Therefore, it can be appreciated that there exists a continuing need for a new and improved table leg leveling device which can be used for stabilizing furniture on uneven ground or the like for improved use. In this regard, the present invention substantially fulfills this need.

SUMMARY OF THE INVENTION

In the view of the foregoing disadvantages inherent in the known types of leveling devices now present in the prior art, the present invention provides an improved table leg leveling device. As such, the general purpose of the present invention, which will be described subsequently in greater detail, is to provide a new and improved table leg leveling device which has all the advantages of the prior art and none of the disadvantages.

To attain this, the present invention essentially comprises a base member having a generally rectangular configuration. The base member has an upper end and a lower end. The upper end is adapted for coupling with a free lower end of a table leg. The upper end has a layer of adhesive disposed thereon for adhering to the free lower end of the table leg. The lower end of the base member has an internally threaded aperture extending upwardly therein. An extension member is adapted for being adjustably received within the internally threaded aperture of the lower end of the base member. The extension member includes a threaded rod having an upper end and a lower end. The upper end is adjustably positioned within the internally threaded aperture. The extension member includes a balancing platform secured to the lower end of the threaded rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved table leg leveling device which has all the advantages of the prior art leveling devices and none of the disadvantages.

It is another object of the present invention to provide a new and improved table leg leveling device which may be easily and efficiently manufactured and marketed.

It is a further object of the present invention to provide a new and improved table leg leveling device which is of durable and reliable construction.

An even further object of the present invention is to provide a new and improved table leg leveling device which is susceptible of a low cost of manufacture with regard to both materials and labor, and which accordingly is then susceptible of low prices of sale to the consuming public, thereby making such a table leg leveling device economically available to the buying public.

Even still another object of the present invention is to provide a new and improved table leg leveling device for stabilizing furniture on uneven ground or the like for improved use.

Lastly, it is an object of the present invention to provide a new and improved table leg leveling device including a base member having an upper end and a lower end. The upper end is adapted for coupling with a free lower end of a table leg. The lower end of the base member has an internally threaded aperture extending upwardly therein. An extension member is adapted for being adjustably received within the internally threaded aperture of the lower end of the base member. The extension member includes a threaded rod having an upper end and a lower end. The upper end is adjustably positioned within the internally threaded aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
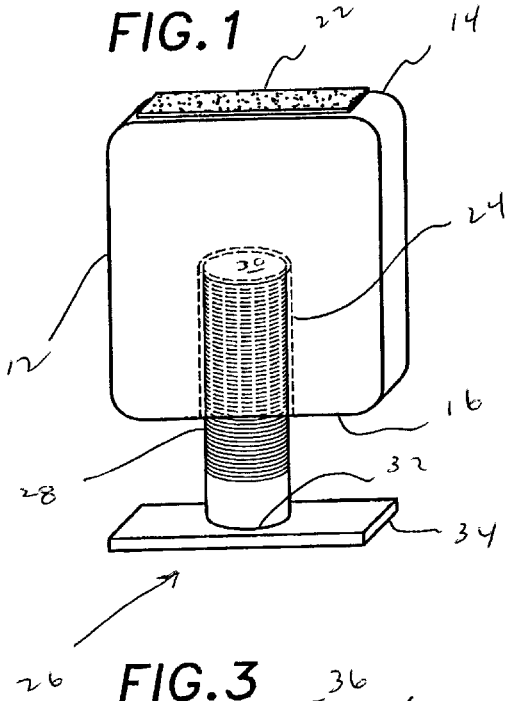
FIG. 1 is a perspective view of the preferred embodiment of the table leg leveling device constructed in accordance with the principles of the present invention.

With reference now to the drawings, and in particular, to FIGS. 1 through 4 thereof, the preferred embodiment of the new and improved table leg leveling device embodying the principles and concepts of the present invention and generally designated by the reference number 10 will be described.

Specifically, it will be noted in the various Figures that the device relates to a table leg leveling device for stabilizing furniture on uneven ground or the like for improved use. In its broadest context, the device consists of a base member and an extension member. Such components are individually configured and correlated with respect to each other so as to attain the desired objective.

The base member 12 has a generally rectangular configuration. Note FIG. 1. The base member 12 has an upper end 14 and a lower end 16. The upper end 14 is adapted for coupling with a free lower end 18 of a table leg 20. it should be noted that the present invention could be used on other types of furniture that are equipped with individual leas. The upper end 14 has a layer of adhesive 22 disposed thereon for adhering to the free lower end 18 of the table leg 20. The lower end 16 of the base member 12 has an internally threaded aperture 24 extending upwardly therein. The internally threaded aperture 24 has a top limit located below the upper end 14 of the base member 12.

Figure 2:
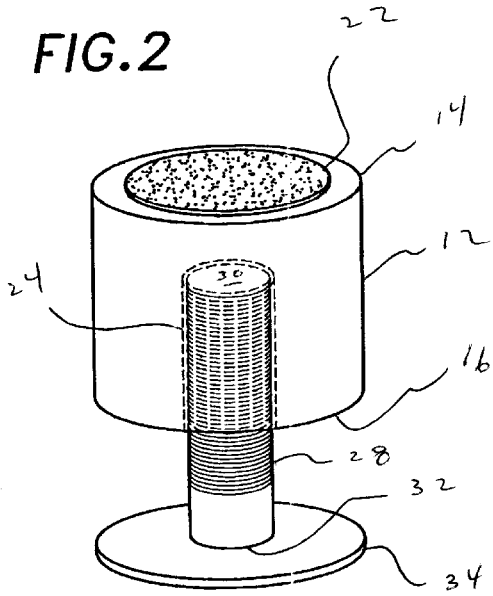
FIG. 2 is a perspective view of an alternate design of the present invention.
Figure 3:
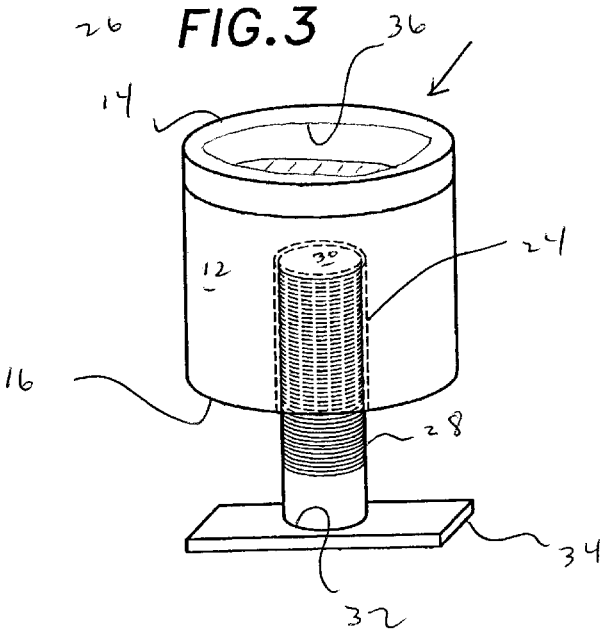
FIG. 3 is a perspective view of an alternate design of the present invention.
Figure 4:
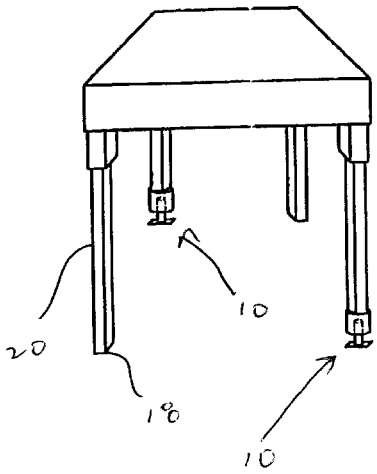
FIG. 4 is a perspective view of the present invention illustrated in use.

The extension member 26 is adapted for being adjustably received within the internally threaded aperture 24 of the lower end 16 of the base member 12. The extension member 26 includes a threaded rod 28 having an upper end 30 and a lower end 32. The upper end 30 is adjustably positioned within the internally threaded aperture 24 until the upper end 30 reaches the top limit of the internally threaded aperture 24, as shown in FIGS. 1, 2, and 3. The extension member 26 includes a balancing platform 34 secured to the lower end 32 of the threaded rod 28. Additionally, as can be noted from the figures, the shape of the balancing platform 34 can take a variety of shapes and sizes. In use, a person would rotate the extension rod 26 until an overall height of the present invention will allow an uneven table or other piece of furniture to be leveled.

In alternate designs of the present invention, specifically referring to figures two and three, the base member 12 is cylindrical in shape. As seen in FIG. 3, the layer of adhesive 22 has been replaced by a recess 36 which will receive the free lower end 18 of the table leg 20 therein as a means of coupling the present invention to the table leg 20. As can be viewed in FIG. 4, more than one of the present invention can be used to achieve the end result of a stabilized table or other piece of furniture that is equipped with individual legs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A table leg leveling device for stabilizing furniture on uneven ground for improved use comprising, in combination:

a base member having a generally rectangular configuration, the base member having an upper end and a lower end, the upper end being adapted for coupling with a free lower end of a table leg, the upper end having a layer of adhesive disposed thereon for adhering to the free lower end of the table leg, the lower end of the base member having an internally threaded aperture extending upwardly therein that has a top limit located below the upper end of the base member; and an extension member adapted for being adjustably received within the internally threaded aperture of the lower end of the base member, the extension member including a threaded rod having an upper end and a lower end, the upper end being adjustably positioning within the internally threaded aperture up to the top limit of the base member, the extension member including a balancing platform secured to the lower end of the threaded rod.

2. A table leg leveling device for stabilizing furniture on uneven ground for improved comprising, in combination:

a base member having an upper end and a lower end, the upper end being adapted for coupling with a free lower end of a table leg, the lower end of the base member having an internally threaded aperture extending upwardly therein that has a top limit located below the upper end of the base member; and an extension member adapted for being adjustably received within the internally threaded aperture of the lower end of the base member, the extension member including a threaded rod having an upper end and a lower end, the upper end being adjustably positioned within the internally threaded aperture up to the top limit of the base member.

3. The table leg leveling device as set forth in claim 2, wherein the base member has a generally cylindrical configuration.

4. The table leg leveling device as set forth in claim 3, wherein the upper end of the base member has a layer of adhesive disposed thereon for adhering to the free lower end of the table leg.

5. The table leg leveling device as set forth in claim 3, wherein the upper end of the base member has a recess formed therein for receiving the free lower end of the table leg therein.

6. The table leg leveling device as set forth in claim 2, wherein the extension member includes a balancing platform secured to the lower end of the threaded rod.

* * * * *